US006183881B1

(12) United States Patent
Shimizu

(10) Patent No.: US 6,183,881 B1
(45) Date of Patent: Feb. 6, 2001

(54) MAGNETIC THIN FILM AND METHOD FOR FORMING THE SAME

(75) Inventor: Sanae Shimizu, Kawasaki (JP)

(73) Assignee: Fujitsu Limited, Kawasaki (JP)

( * ) Notice: Under 35 U.S.C. 154(b), the term of this patent shall be extended for 0 days.

(21) Appl. No.: 09/366,277

(22) Filed: Aug. 2, 1999

(30) Foreign Application Priority Data

Aug. 4, 1998 (JP) ..... 10-220011

(51) Int. Cl.[7] ..... H01F 1/00; C25D 3/56

(52) U.S. Cl. ..... 428/611; 148/310; 148/312; 205/255; 205/259; 205/260; 205/922; 428/655; 428/679; 428/680; 428/681; 428/692; 428/694 TM; 428/928; 428/935

(58) Field of Search ..... 428/611, 655, 428/680, 681, 679, 928, 935, 694 TM, 692; 365/171; 148/310, 312; 205/255, 259, 260, 119, 922

(56) References Cited

U.S. PATENT DOCUMENTS 3,271,274 * 9/1966 Di Guilio et al. ..... 205/259

FOREIGN PATENT DOCUMENTS 51-18370 * 6/1976 (JP) ..... 205/260
54-28952 * 9/1979 (JP) ..... 205/260
7122426 5/1995 (JP) .
9063016 3/1997 (JP) .

* cited by examiner

*Primary Examiner*—Deborah Jones
*Assistant Examiner*—Robert R. Koehler
(74) *Attorney, Agent, or Firm*—Greer, Burns & Crain, Ltd.

(57) ABSTRACT

A magnetic thin film forming method forms a magnetic thin film on a conductive film by electroplating using a plating bath containing Ni ions, Fe ions, Mo ions and an organic acid. A concentration of the organic acid in the plating bath is 3–20 times a concentration of the Mo ions in the plating bath. An organic acid concentration in the plating bath versus an Mo ion concentration of the plating bath is set to be a suitable value, whereby an Mo mixed amount in the magnetic thin film can be set to be a suitable value. Accordingly, a magnetic thin film having a large specific resistance value and good magnetic characteristics can be formed.

9 Claims, 7 Drawing Sheets

MAGNETIC THIN FILM AND METHOD FOR FORMING THE SAME

BACKGROUND OF THE INVENTION

The present invention relates to a magnetic thin film and a method for forming the magnetic thin film, more specifically to a magnetic thin film having a high specific resistance value and a method for forming the magnetic thin film.

Conventionally magnetic thin films, which have good soft magnetic characteristics, have been used as the magnetic cores for use in thin-film magnetic devices, such as thin-film magnetic heads, thin-film transformers, thin-film inductors, etc.

Magnetic thin films of especially Permalloy (iron-nickel alloy) are widely used as upper magnetic cores, etc. of recording heads of hard disk devices because of their high magnetic permeability, good soft magnetic characteristics and low magneto striction.

However, magnetic thin film of Permalloy, a specific resistance value of which is as low as about 20 $\mu\Omega$cm, has large loss for high-frequency magnetic fields of above 10's MHZ due to eddy current, which makes it difficult that the magnetic thin film can have good high-frequency characteristics.

Then techniques for forming magnetic thin film of high specific resistance values by mixing Mo (molybdenum) in Permalloy have been proposed.

In Japanese Patent Laid-Open Publication No. 122426/1995, for example, discloses a multi-layer film formed of a layer having a larger Mo mixed amount and a higher specific resistance value and a layer having a smaller Mo mixed amount laid sequentially one on the other. It is described that such multi-layer Permalloy film has good soft magnetic characteristics. Such multi-layer film is formed by electric plating using a bath with Mo ions added, and the Mo mixed amounts in the magnetic thin films are adjusted by changing a current density. It is described that tartaric acid is added to the Permalloy bath so as to largely change Mo mixed amounts in the magnetic thin films.

Japanese Patent Laid-Open Publication No. 63016/1997 discloses a magnetic thin film formed of Permalloy containing molybdenum, chrome and tungsten. It is described that such magnetic thin film has an above 1.5 T (tesla) saturation magnetic flux density, a below 1.0 Oe (oersted) coercive force Hc and an above 40 $\mu\Omega$cm specific resistance value.

However, Japanese Patent Laid-Open Publication No. 122426/1995 and Japanese Patent Laid-Open Publication No. 63016/1997 do not disclose at all how to suitably control an Mo mixed amount to be introduced into magnetic thin film. Magnetic characteristics of magnetic thin film of Permalloy tends to much change by an Mo mixed amount. It is very important to establish a technique for suitably controlling an Mo mixed amount.

SUMMARY OF THE INVENTION

An object of the present invention is to provide a magnetic thin film having a high specific resistance value and good magnetic characteristics, and a method for forming the magnetic thin film.

The above-described object is achieved by a method for forming a magnetic thin film on a conductive film by electroplating using a plating bath containing Ni ions, Fe ions, Mo ions and an organic acid, a concentration of the organic acid in the plating bath being 3–20 times a concentration of the Mo ions in the plating bath. A concentration of an organic acid in the plating bath versus to a concentration of the Mo ions in the plating bath is set to be a suitable value, whereby an Mo mixed amount in the magnetic thin film can be set to be a suitable value. A magnetic thin film having a large specific resistance value and good magnetic characteristics can be formed.

In the above-described magnetic thin film forming method it is preferable that the organic acid is oxycarboxylic acid or salt of oxycarboxylic acid.

In the above-described magnetic thin film forming method it is preferable that a concentration of the organic acid in the plating bath is above 0.001 mol/l.

In the above-described magnetic thin film forming method it is preferable that a concentration of the organic acid in the plating bath is above 0.005 mol/l. An Mo mixed amount in the magnetic thin film can be set stable.

The above-described object is achieved by a magnetic thin film formed on a conductive film formed by electroplating using a plating bath containing Ni ions, Fe ions, Mo ions and an organic acid, the magnetic thin film being formed by setting a concentration of the organic acid in the plating bath to be 3–20 times a concentration of the Mo ions in the plating bath, and containing Mo by 1–5 atomic %. Mo is contained by 1–5 atomic % in the magnetic thin film. The magnetic thin film can have a large specific resistance value and good magnetic characteristics.

DETAILED DESCRIPTION OF THE INVENTION

Figure 1:
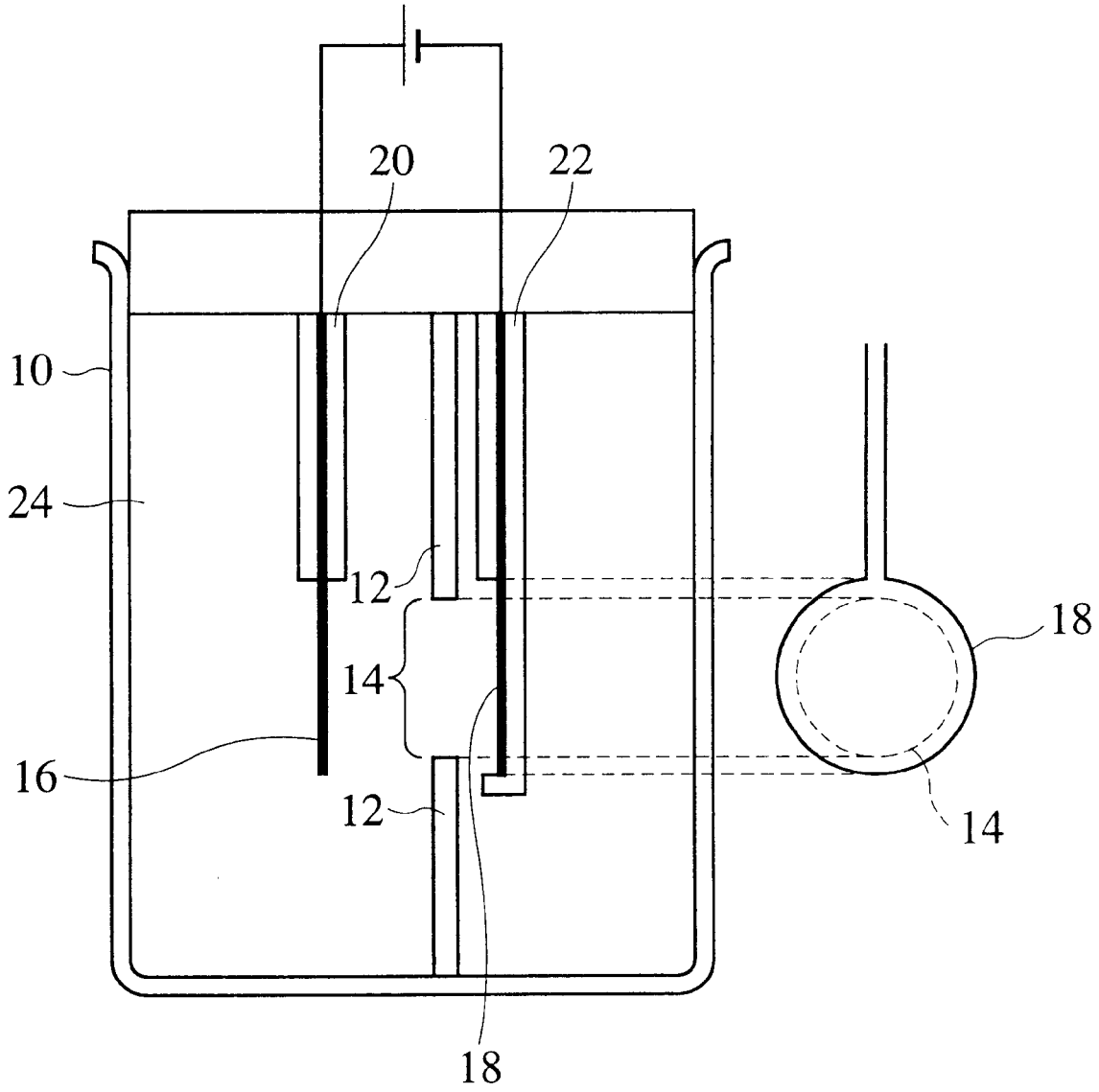
FIG. 1 is a diagrammatic view of the cell for the electroplating.
Figure 2:
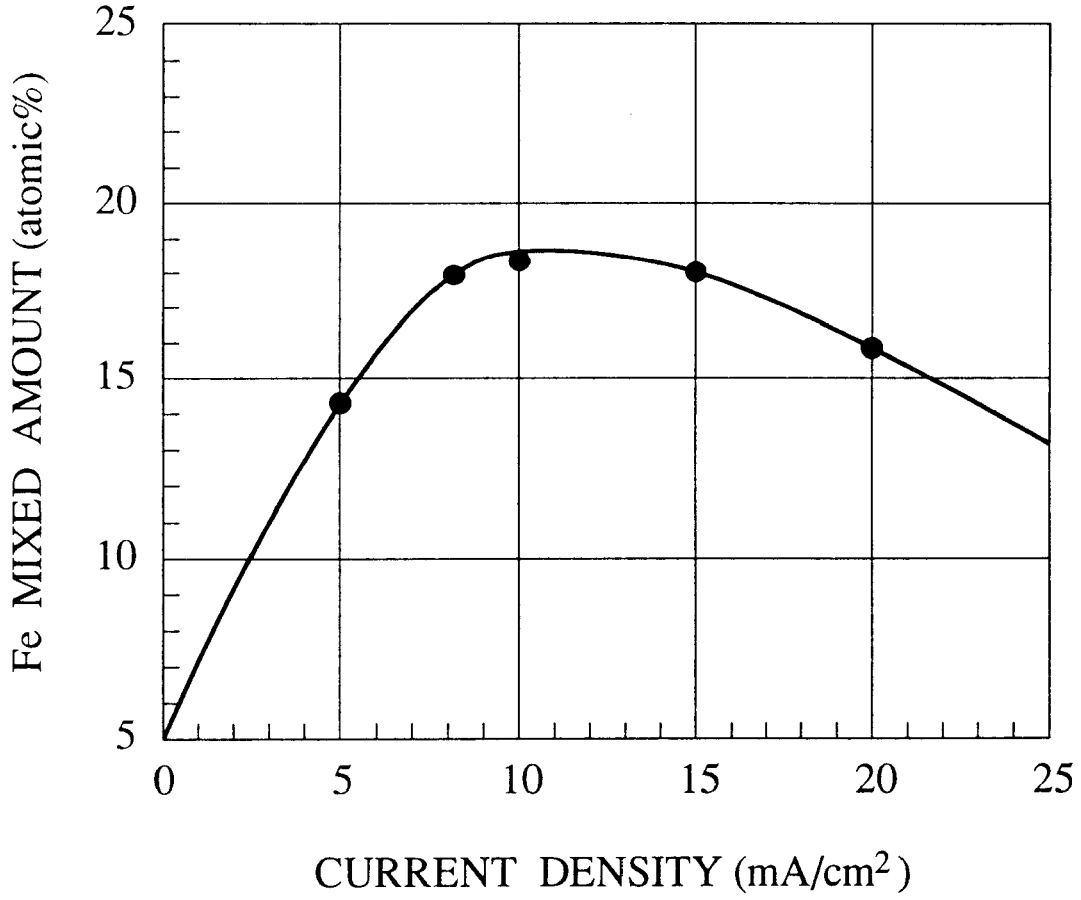
FIG. 2 is a graph of relationships between current densities and Fe mixed amounts in the magnetic thin film.
Figure 3:
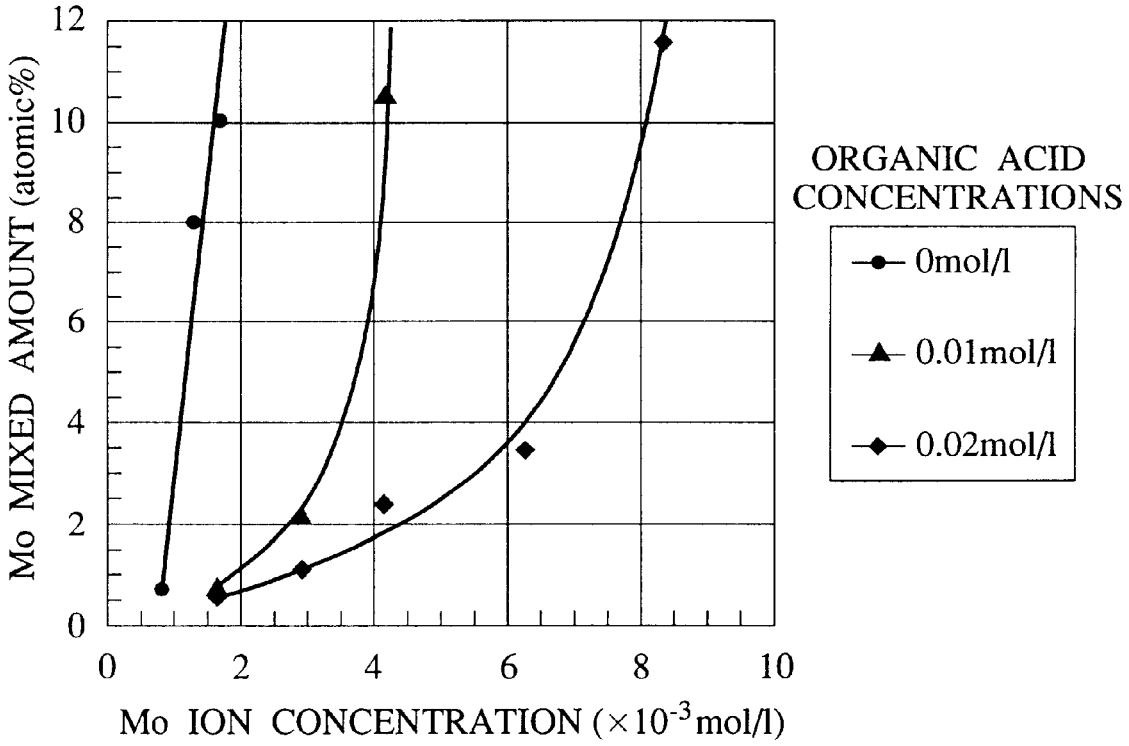
FIG. 3 is a graph of relationships between Mo ion concentrations in the plating bath and Mo mixed amounts in the magnetic thin film.
Figure 4:
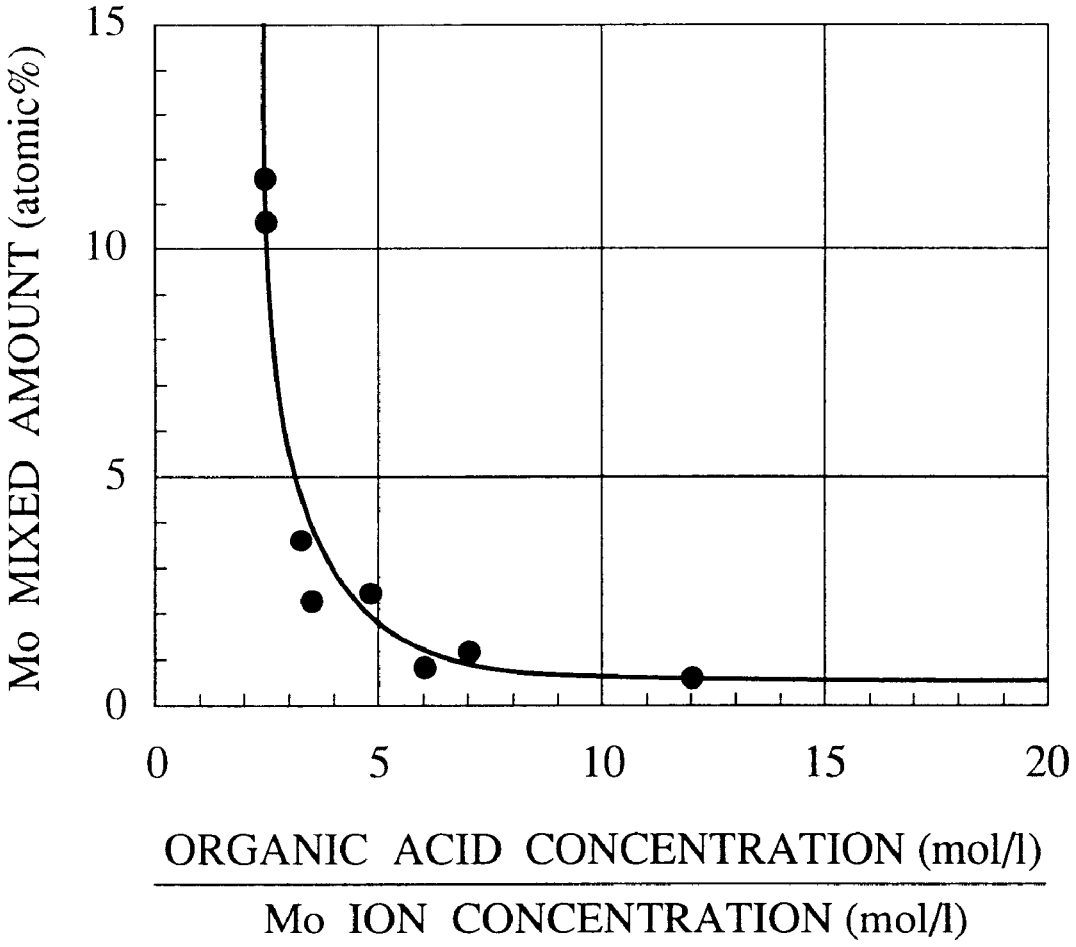
FIG. 4 is a graph of relationships between values given by dividing organic acid concentrations by Mo ion concentrations, and Mo mixed amounts in the magnetic thin film.
Figure 5:
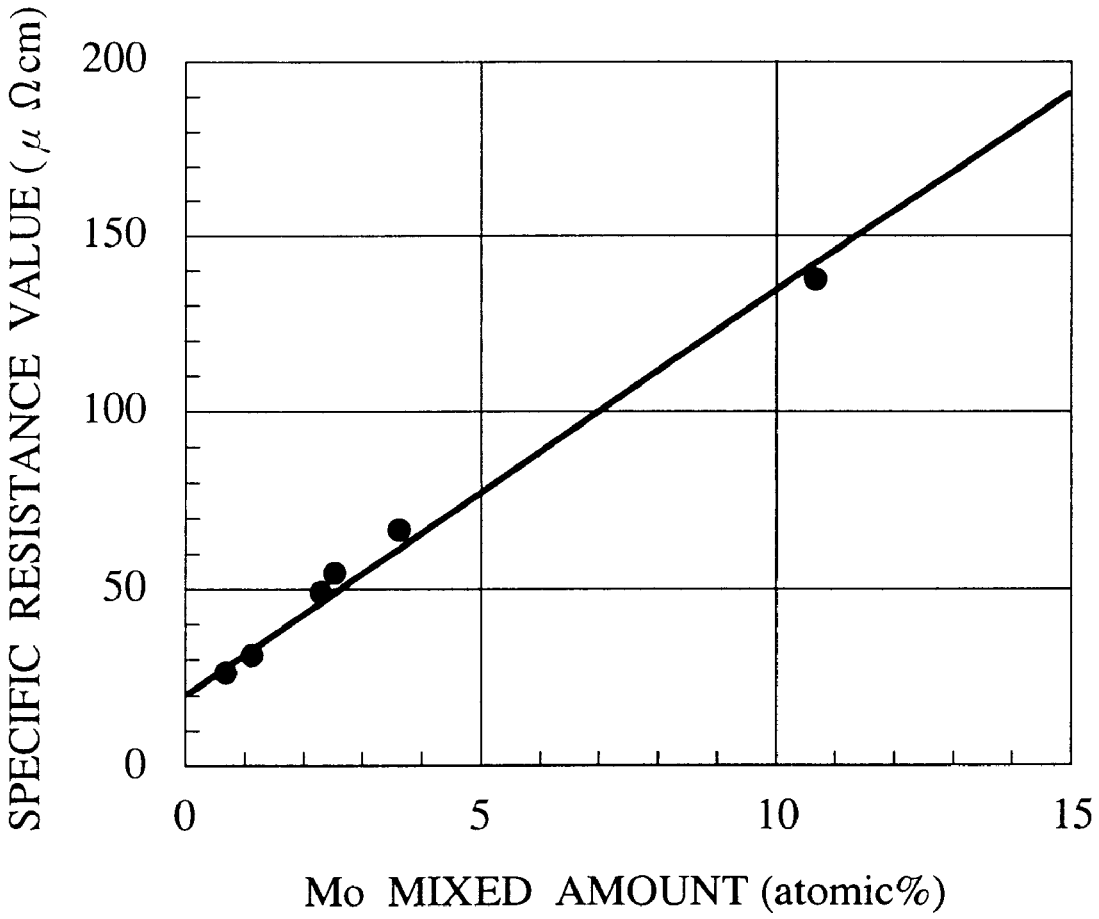
FIG. 5 is a graph of relationships between Mo mixed amounts in the magnetic thin film and specific resistance values of the magnetic thin film.
Figure 6:
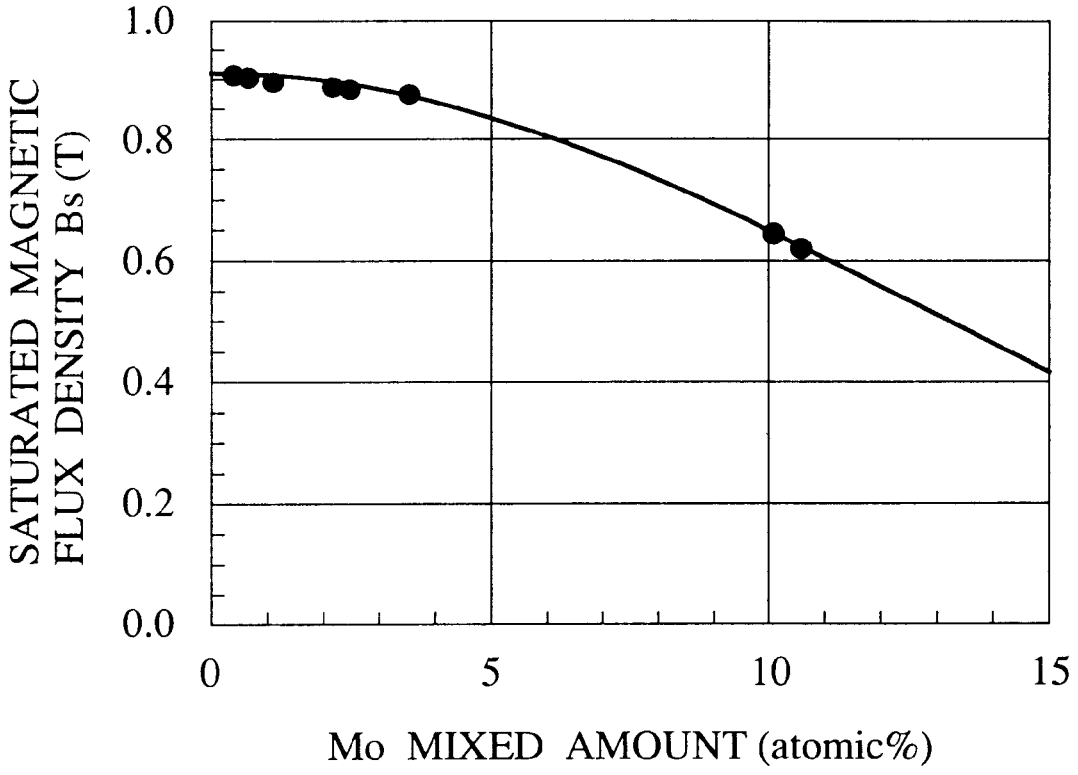
FIG. 6 is a graph of Mo mixed amounts in the magnetic thin film and saturated magnetic flux densities Bs of the magnetic thin film.
Figure 7:
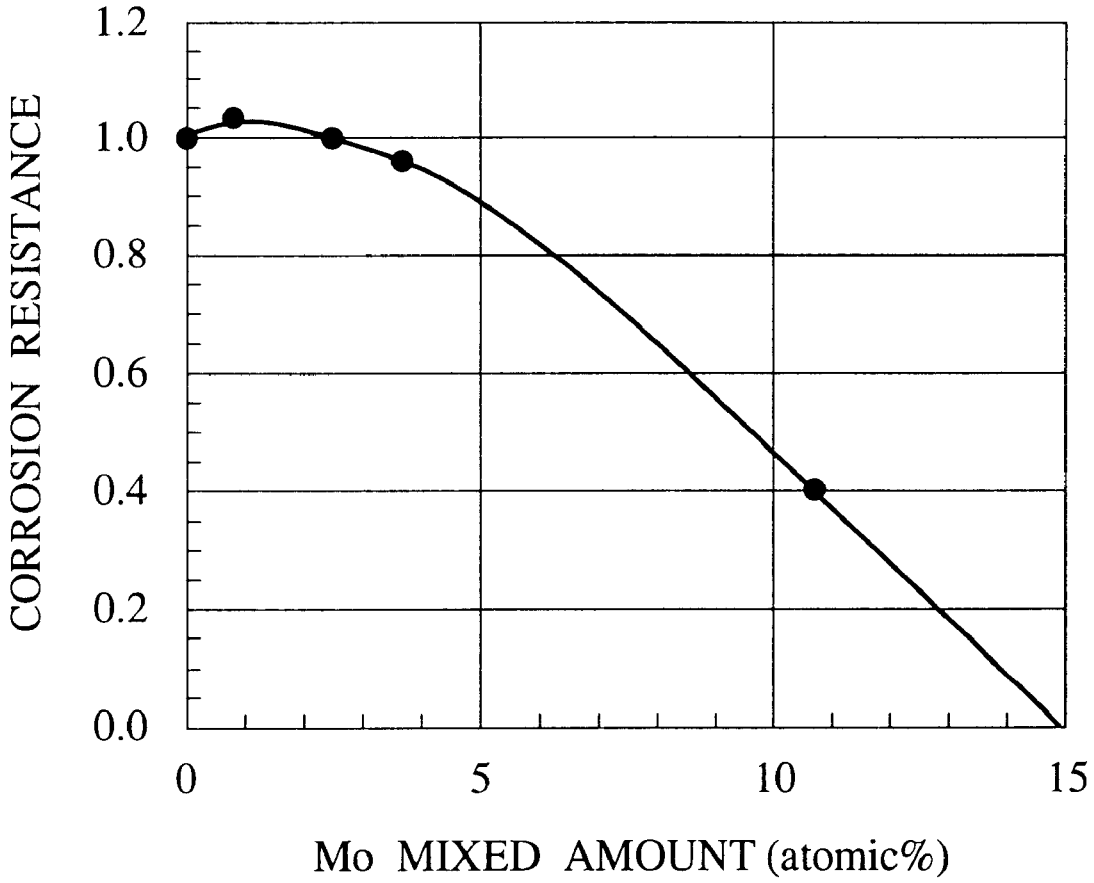
FIG. 7 is a graph of relationships between Mo mixed amounts in the magnetic thin film and corrosion resistance of the magnetic thin film.

The method for forming a magnetic thin film according to a embodiment of the present invention will be explained with reference to FIGS. 1 to 7. FIG. 1 is a diagrammatic view of a cell for electroplating. FIG. 2 is a graph of relationships between current densities and Fe mixed amounts in a magnetic thin film. FIG. 3 is a graph of relationships between Mo ion concentrations and Mo mixed amounts in a magnetic thin film. FIG. 4 is a graph of relationships between values given by dividing organic acid concentrations by Mo ion concentrations, and Mo mixed amounts in a magnetic thin film. FIG. 5 is a graph of relationships between Mo mixed amounts in the magnetic thin film and specific resistance values of the magnetic thin film. FIG. 6 is a graph of Mo mixed amounts in the magnetic thin film and saturated magnetic flux densities Bs of the magnetic thin film. FIG. 7 is a graph of relationships between Mo mixed amounts in a magnetic thin film and corrosion resistance of the magnetic thin film.

In the method for forming the magnetic thin film according to the present embodiment, the magnetic thin film is formed on a conductive film by electroplating using a plating bath containing Ni(nickel) ions, Fe(ferrum) ions, Mo ions and an organic acid. The method is characterized mainly in that a concentration of the organic acid in the plating bath is set to be about 3–20 times that of the Mo ions in the plating bath, whereby the magnetic thin film can have high specific resistance value and good magnetic characteristics.

First, the method for forming the magnetic thin film on a conductive layer by electroplating will be explained with reference to FIG. 1. FIG. 1 is a diagrammatic view of a cell for the electroplating. In FIG. 1, the drawing on the right side of the drawing is for the purpose of showing a positional relationship between an aperture in a shield plate and a cathode, and shows a view given when a cell shown on the left side of the drawing is viewed on the right side of the drawing.

As shown in FIG. 1, the shield plate 12 of plastics is disposed in a vessel 10, and a circular aperture 14 is formed in the shield plate 12. A disk-shaped anode 16 is disposed in the vessel 10 on the left side of the shield plate 12 as viewed in the drawing. The cathode 18 in a disk-shaped is disposed on the right side of the shield plate 12 as viewed in the drawing. The anode 16 and the cathode 18 are opposed to each other across the aperture 14 formed in the shield plate 12. The anode 16 is supported by anode support means 20, the cathode 18 is supported by cathode support means 22.

The anode 16 is formed of, e.g., an Ni plate. In FIG. 1, for convenience, the cathode 18 is shown in the same shape as the anode 16, but in fabricating an actual device, a conductive film which is to be a base for the magnetic thin film to be formed on corresponds to the cathode. Such conductive film may be provided by a binary alloy thin film of, e.g., 75–85 atomic % of Ni and 15–25 atomic % of Fe.

The vessel 10 is filled with a plating bath 24. Current flows in the plating bath 24 through the aperture 14 in the shield plate 12 when the anode 16 is connected to the plus side of an electric source, and the cathode 18 is connected in the minus side of the electric source. Because the anode 16 and the cathode 18 are disk-shaped, and the aperture 14 in the shield plate 12 is also circular, current of a substantially uniform current density flow through the plating bath 24 between the anode 16 and the cathode 18.

Thus, a magnetic thin film of Permalloy is formed on the surface of the cathode 18.

(Current Density)

A current density of current flowing through the plating bath 24 between the anode 16 and the cathode 18 through the aperture 14 formed in the field plate 12 can be set to be in, e.g., a 10–15 mA/cm$^2$ range.

FIG. 2 shows relationships between current densities and Fe mixed amounts in the magnetic thin film, which were measured to give a suitable current density. In FIG. 2, current densities of current flowing through the plating bath between the anode and the cathode are taken on the horizontal axis, and Fe mixed amounts in the magnetic thin film are taken on the vertical axis.

As seen in FIG. 2, an Fe mixed amount in the magnetic thin film is substantially constantly about 18 atomic % in a 10–15 mA/cm$^2$ current density range. Accordingly, a magnetic thin film having a stable composition can be formed by setting a current density in a 10–15 mA/cm$^2$ range. A current density is not essentially set to be in a 10–15 mA/cm$^2$ range and may be set suitably so that a magnetic thin film having a required composition can be formed.

(Plating Bath)

The plating bath may be a plating bath which can be form Permalloy, e.g., Burns-Warner bath, Wolf bath, low concentration bath or others.

Burns-Warner bath is a sulfate-chloride type bath proposed by R. M. Burns and C. W. Warner, Bell Laboratories, and can form a magnetic thin film of Permalloy having an about 80% Ni mixed amount. Plating conditions may be, for example, 212 g/l of nickel sulfate, 22 g/l of ferric sulfide, 18 g/l of nickel chloride, 2.5 g/l ferric chloride, 25 g/l of boric acid, 180 g/l of sodium sulfate and a 50° C. temperature.

Wolf bath is a sulfate-chloride type plating bath for plating in a magnetic field for forming Permalloy having magnetic anisotropy and contains saccharin for smaller film stress (I. W. Wolf, J. Appl. Phys, 33, 1152, 1962). Plating conditions may be, for example, 293 g/l of nickel sulfate, 6.2 g/l of ferric sulfide, 0.42 g/l of sodium lauryl sulfate, 9.7 g/l of sodium chloride, 25 g/l of boric acid, 14 ml/l of strong sulfuric acid and 0.5 g/l of saccharin.

Low concentration bath is a sulfate-chloride bath. Plating conditions may be, for example, 35.3 g/l of nickel chloride, 14.7 g/l of nickel sulfate, 1.2 g/l of ferric sulfide, 25 g/l of boric acid, 0.75 g/l of saccharin, 25 g/l of sodium oxide and a 23° C. temperature.

Plating conditions of Burns-Warner bath, Wolf bath and low concentration bath are not limited to the above-described plating conditions and may be changed suitably in a range which ensures basic characteristics of Burns-Warner bath, Wolf bath and low concentration bath.

The plating bath is not limited to Burns-Warner bath, Wolf bath and low concentration bath, and any plating bath may be used as long as the bath can form a magnetic thin film of Permalloy.

(Mo Supply Source)

To add Mo ions to the plating bath an Mo supply source is added to the plating bath. An Mo supply source may be, e.g., sodium molybdate, ammonium molybdate or others.

(Organic Acid)

An organic acid added to the plating bath may be, e.g., oxycarboxylic acid or a salt of oxycarboxylic acid.

Oxycarboxylic acid may be, e.g., tartaric acid, lactic acid or others. A salt of oxycarboxylic acid may be, e.g., sodium tartrate, Rochelle salt, sodium lactate, sodium malic acid or others.

A concentration of an organic acid added to the plating bath may be, for the following reason, e.g., above 0.001 mol/l, preferably above 0.005 mol/l and more preferably above 0.01 mol/l.

FIG. 3 shows results of Mo mixed amounts in the magnetic thin film for Mo ion concentrations measured respectively when no organic acid is added, an organic acid concentration is 0.01 mol/l, and an organic acid concentration is 0.02 mol/l. Mo ion concentrations in the plating bath are taken on the horizontal axis, and Mo mixed amounts in the magnetic thin film are taken on the vertical axis.

As seen in FIG. 3, without an organic acid added, an Mo mixed amount in the magnetic thin film abruptly increases even with a small Mo ion concentration change. That is, the Mo mixed amount in the magnetic thin film has a high change ratio to Mo ion concentration change.

In contrast to this, when an organic acid concentration is 0.01 mol/l, a change ratio of an Mo mixed amount in the magnetic thin film with respect to an Mo ion concentration change is lower in comparison with when no organic acid is added.

Furthermore, when an organic acid concentration is 0.02 mol/l, a change ratio of an Mo mixed amount in the magnetic thin film versus an Mo ion concentration change is further smaller.

Thus, there is a tendency that as an organic acid concentration added in the plating bath is higher, a change ratio of an Mo mixed amount in the magnetic thin film to an Mo ion concentration change is smaller. In consideration of all specific resistance value, saturated magnetic flux density Bs, corrosion resistance, etc., it is preferable that an Mo mixed amount in the magnetic thin film is 1–5 atomic %. As seen in FIG. 3, as an organic acid concentration is higher, an Mo mixed amount in the magnetic thin film can be stably 1–5 atomic %.

Accordingly, an organic acid concentration is above 0.005 mol/l, and more preferably above 0.01 mol/l. Thus, a small amount of Mo can be stably mixed in the magnetic thin film.

An organic acid concentration is not limited to above 0.005 mol/l, and at least an organic acid may be added to the plating bath. Accordingly, for example, an organic acid concentration may be above 0.001 mol/l or may be lower. When an organic acid concentration is as low as about 0.001 mol/l, an Mo mixed amount in the magnetic thin film largely changes with respect to an Mo ion concentration change, but a small amount of Mo can be mixed in the magnetic thin film by suitably setting an Mo ion concentration so that an Mo mixed amount in the magnetic thin film can be a required value.

As seen also in FIG. 3, an Mo mixed amount in the magnetic thin film decreases as an organic acid concentration in the plating bath increases, and as an Mo ion concentration increases, an Mo mixed amount in the magnetic thin film increases. Based on this, it is considered that an organic acid concentration versus an Mo ion concentration much influences an Mo mixed amount in the magnetic thin film.

(Organic Acid Concentration Versus Mo Ion Concentration)

An organic acid concentration may be, e.g., 3–20 times an Mo ion concentration.

FIG. 4 shows results of relationships between values given by dividing organic acid concentrations by Mo ion concentrations, and Mo mixed amounts in the magnetic thin film, which were measured to give suitable values of organic acid concentrations versus Mo ion concentrations in the plating bath. In FIG. 4, values given by organic acid concentrations in the plating bath by Mo ion concentrations in the plating bath are taken on the horizontal axis, and Mo mixed amounts in the magnetic thin film are taken on the vertical axis.

When specific resistance value, saturated magnetic flux density Bs, corrosion resistance, etc. are all considered, it is preferable that an Mo mixed amount in the magnetic thin film is 1–5 atomic %. As seen in FIG. 4, an Mo mixed amount in the magnetic thin film can be 1–5 atomic % by setting an organic acid concentration to be in a range of 3–20 times an Mo ion concentration.

(Specific Resistance Value)

Specific resistance values of the magnetic thin film with respect to Mo mixed amounts in the magnetic thin film will be explained with reference to FIG. 5. FIG. 5 is a graph of specific resistance values of the magnetic thin film with respect to Mo mixed amounts in the magnetic thin film. In FIG. 5, Mo mixed amounts in the magnetic thin film are taken on the horizontal axis, and specific resistance values of the magnetic thin film are taken on the vertical axis.

As seen in FIG. 5, specific resistance values change linearly with respect to Mo mixed amounts in the magnetic thin film. As described above, an Mo mixed amount in the magnetic thin film is suitably set, whereby the magnetic thin film can have a required specific resistance value.

As seen in FIG. 5, when an Mo mixed amount in the magnetic thin film is set to be, e.g., 1–5 atomic %, a specific resistance value can be about 20–100 $\mu\Omega$cm.

Because the specific resistance value is substantially proportional to the Mo mixed amount in the magnetic thin film, it is considered to increase an Mo mixed amount in the magnetic thin film, so that the magnetic thin film has a higher specific resistance value. However, when an Mo mixed amount in the magnetic thin film is large, a saturated magnetic flux density Bs decreases, and corrosion resistance of the magnetic thin film is degraded. Accordingly, it is preferable to suitably set an Mo mixed amount in the magnetic thin film in range in which a required saturated magnetic flux density Bs and a required corrosion resistance can be obtained.

(Saturated Magnetic Flux Density)

Relationships between Mo mixed amounts in the magnetic thin film and saturated magnetic flux densities Bs of the magnetic thin film will be explained with reference to FIG. 6. FIG. 6 shows a graph of relationships between Mo mixed amounts in the magnetic thin film and saturated magnetic flux densities Bs of the magnetic thin film. In FIG. 6, Mo mixed amounts in the magnetic thin film are taken on the horizontal axis, and saturated magnetic flux densities Bs of the magnetic thin film are taken on the vertical axis.

As seen in FIG. 6, when an Mo mixed amount in the magnetic thin film is 1–5 atomic %, the magnetic thin film can have a saturated magnetic flux density Bs as high as about 0.9 T(tesla). An Mo mixed amount in the magnetic thin film is not essentially limited to 1–5 atomic % and can be set suitably in a range in which a required saturated magnetic flux density Bs can be obtained.

(Corrosion Resistance)

Relationships between Mo mixed amounts in the magnetic thin film and corrosion resistance of the magnetic thin film will be explained with reference to FIG. 7. FIG. 7 shows relationships between Mo mixed amounts in the magnetic thin film and corrosion resistance of the magnetic thin film. In FIG. 7, Mo mixed amounts in the magnetic thin film are taken on the horizontal axis, and corrosion resistance of the magnetic thin film is taken on the vertical axis. The corrosion resistance of the magnetic thin film was evaluated based on pitting corrosion potentials measured by anodic polarization measurement. Anodic polarization measurement is a method in which a specimen, i.e., the magnetic thin film as the anode is disposed opposed to the cathode in a solution of sodium chloride or others, and current-voltage characteristics at the time that a voltage is applied to between the anode and the cathode are measured to thereby measure characteristics of the specimen. Here the pitting potential is a potential at which as a source voltage is gradually increased, a current-voltage curve becomes flat for a short period of time, and then a current value beings to abruptly increase. Accordingly, the higher a pitting potential is, the higher the corrosion resistance is. In FIG. 7, pitting potentials relative to a pitting corrosion potential of a magnetic thin film of Permalloy without Mo mixed in, which is set to be 1 (one) are taken on the vertical axis.

As seen in FIG. 7, when an Mo mixed amount in the magnetic thin film is in a range of 1–5 atomic %, the corrosion resistance can be about 1.0. That is, corrosion resistance which is substantially equal to that of the magnetic thin film of Permalloy without Mo mixed in can be obtained. An Mo mixed amount in the magnetic thin film is not essentially limited to 1–5 atomic % and can be suitably set in a range in which a required corrosion resistance can be obtained.

When an Mo mixed amount in the magnetic thin film is in a range of 1–5 atomic %, coercive force Hc is below 1 Oe(oersted), and a magneto striction is below $2\times10^{-6}$. That is, magnetic characteristics substantially equal to those of the magnetic thin film of Permalloy without Mo mixed in can be obtained.

As described above, according to the present embodiment, an organic acid concentration in the plating bath versus an Mo ion concentration of the plating bath is set to be a suitable value, whereby an Mo mixed amount in the magnetic thin film can be set to be a suitable value. Accordingly, a magnetic thin film having a large specific resistance value and good magnetic characteristics can be formed.

[Modifications]

The present invention is not limited to the above-described embodiment and can cover other various modifications.

In the above-described embodiment Mo is mixed in a magnetic thin film of Permalloy, but a substance to be mixed in is not limited to Mo. In place of Mo, W (tungsten), Cr (chromium) or others may be mixed in.

What is claimed is:

1. A method for forming a magnetic thin film on a conductive film by electroplating using a sulphate-chloride type acid plating bath containing Ni ions, Fe ions, Mo ions and an organic acid, a concentration of the organic acid in the plating bath being 3–20 times a concentration of the Mo ions in the plating bath.

2. A method according to claim 1, wherein the organic acid is oxycarboxylic acid or salt of oxycarboxylic acid.

3. A method according to claim 1, wherein a concentration of the organic acid in the plating bath is above 0.001 mol/l.

4. A method according to claim 2, wherein a concentration of the organic acid in the plating bath is above 0.001 mol/l.

5. A method according to claim 1, wherein a concentration of the organic acid in the plating bath is above 0.005 mol/l.

6. A method according to claim 2, wherein a concentration of the organic acid in the plating bath is above 0.005 mol/l.

7. A magnetic thin film formed on a conductive film formed by electroplating using a sulphate-chloride type acid plating bath containing Ni ions, Fe ions, Mo ions and an organic acid, the magnetic thin film being formed by setting a concentration of the organic acid in the plating bath to be 3–20 times a concentration of the Mo ions in the plating bath, and containing Mo by 1–5 atomic %.

8. A method according to claim 1, wherein a pH of the plating bath is from 2 to 4.

9. A magnetic thin film according to claim 7, wherein a pH of the plating bath is from 2 to 4.

* * * * *